US006503128B1

(12) United States Patent
Deware et al.

(10) Patent No.: US 6,503,128 B1
(45) Date of Patent: Jan. 7, 2003

(54) CONTOUR SANDING ATTACHMENT AND METHOD

(76) Inventors: William R. Deware, 4 South Rd., Belmont, NH (US) 03220; William L. Andrews, P.O. Box 1695, Rochester, NH (US) 03867

( * ) Notice: Subject to any disclaimer, the term of this patent is extended or adjusted under 35 U.S.C. 154(b) by 0 days.

(21) Appl. No.: 09/589,507

(22) Filed: Jun. 7, 2000

(51) Int. Cl.[7] ..... B24B 1/00; B24B 21/02

(52) U.S. Cl. ..... 451/59; 451/49; 451/297; 451/311; 451/348; 451/355

(58) Field of Search ..... 451/49, 50, 59, 451/297, 348, 311, 355

(56) References Cited

U.S. PATENT DOCUMENTS 3,093,170 A * 6/1963 Thayer
3,566,549 A * 3/1971 Britton
4,858,390 A * 8/1989 Kenig
5,031,362 A * 7/1991 Relling et al
6,220,946 B1 * 4/2001 Arnold ..... 451/307

* cited by examiner

*Primary Examiner*—Timothy V. Eley
(74) *Attorney, Agent, or Firm*—Michael J. Persson; Lawson, Philpot & Persson P.C.

(57) ABSTRACT

A grinding attachment for use in conjunction with hand-held grinding or drilling power tools such as are commonly found around the house, and method for using this attachment. The purpose of the invention is to allow the homeowner and the like to have greater facility in performing surface sanding, grinding, or finish work on pieces of wood and the like. In particular, the goal is to provide proficiency in working with surfaces that are not planar or otherwise simple. By providing an appropriate compound support against which an abrasive belt or the like is to run as it works the surface, it is possible to have a variety of backing shapes ranging from a strictly planar backing to one that allows the abrasive material to take the shape of whatever piece is being pressed against it. The invention derives its motive power from a coupling to a power tool, typically by the insertion of a drive axle of the attachment into the chuck of a hand drill. The compound support of the attachment includes a means of spring-loading the abrasive belt so as to maintain tension in it. The intended method of use of the attachment will depend on the particular shape of the piece to be worked. The preferred method utilizes an elastic abrasive belt.

12 Claims, 5 Drawing Sheets

CONTOUR SANDING ATTACHMENT AND METHOD

BACKGROUND OF THE INVENTION

1. Field of The Invention

The present invention relates to tools for sanding or grinding. More particularly, the present invention relates to a attachment for use with hand-held power tools for the purpose of grinding or sanding surfaces. More particularly still, the present invention relates to such an attachment and for a method of using it, with special applicability to elastic grinding belts.

2. Description of Related Art

As used in this document, the terms "grinding" and "sanding" are synonymous. Furthermore, a "grinding-belt," a "sanding-belt," a "endless grinding belt," and an "endless belt," are used interchangeably and refer to any closed-loop belt intended for sanding or grinding by means well known in the art. Finally, as used here, "cylinder" has its analytic geometry definition, which includes but is not limited to a cylinder in which the cross-section perpendicular to its axis is an ellipse.

Hand-held power tools used for drilling or grinding have long been popular and are in fact common household items. Building on this popularity, a number of devices directed at improving the sanding and grinding performances of these tools have been disclosed and introduced to the market. Typically, these devices are mechanically coupled to the power tool at the site where a standard attachment such as a drill-bit or sanding-wheel is otherwise placed. In spite of the advantages that these add-on devices may provide, they have not adequately addressed the problems associated with grinding or sanding surfaces intended to be non-flat. This is because these existing devices present either a flat or fixed-radius surface as a backing for the grind/sanding belt, a serious limitation for ornate work pieces incorporating curved portions. As a consequence portions of such complex and ornate work-pieces tend to be either over-worked or under-worked during the finishing process.

Nace (U.S. Pat. No. 4,551,951; 1985) discloses a detachable portable continuous-belt driving head for use in conjunction with an air-driven rotatable spindle. By wrapping a sanding belt around the work-piece, the Nace device can be used to sand or grind a significant portion of the circular contour of a cylindrical work-piece such as a pipe However, wrapping such a belt around an uninterrupted span of pipe requires that the belt be 'seamed,' that is that it has seam where it can be opened and then rejoined. In other words, before the Nace device can be used on a pipe, the ends of the grinding belt must be separated at the seam, the belt must be wrapped around the pipe, and the ends of the belt must be rejoined. This process is time consuming. Furthermore the use of seam-containing grinding belts can be hazardous, since they are vulnerable to operator error in connecting and disconnecting the belt that can lead to the belt flying off the rollers, causing injury or damage.

Kenig (U.S. Pat. No. 4,858,390; 1989) and Reiling et al. (U.S. Pat. No. 5,031,362; 1991) disclose similar endless-belt grinding attachments for use in conjunction with typical hand-held electric or pneumatic power-drills. Both of the Kenig and the Reiling et al. devices have a drive-pulley, driven by the output of a power tool, and an idler-pulley disposed at the end (distal to the drive pulley)of an arm member. In use, a grinding belt is mounted on these pulleys. Because the grinding belt so mounted conforms to a single longitudinal axis, these devices are limited to relatively small angles of contact when used with work-pieces having curved contours, such as pipes or toroidal shapes. Consequently, it is difficult to use the device of either Reiling et al. or Kenig to satisfactorily grind such curved surfaces.

Another invention using an endless grinding belt is that of Appleton (U.S. Pat. No. 4,578,906; 1986). The Appleton device is similar to those of Kenig and Reiling et al. in that it has two pulleys, one being a drive-pulley. These pulleys are mounted at the ends of a longitudinal arm-member. An endless grinding belt fits over the pulleys and is stretched to an essentially flat configuration, so that it presents a flat grinding surface to the work piece. A spring is mounted coaxially with arm-member and is used as a bias means for keeping the belt under tension and thus flat. The Appleton device has the same limitations as those described above. In addition, that fact that the Appleton device adds a motor for driving the drive pulley means that it is not just an attachment for a pre-existing power tool.

What is needed, therefore, is a an endless-belt device that can be used in conjunction with existing hand-held power grinding and drilling tools so as to enable those tools to more easily and effectively grind and sand work pieces that present curved surfaces. What is further needed is such an apparatus that can work the surface of complex, ornate shapes. What is further needed is a such an apparatus that can also provide proper backing for finish work on flat surfaces of a work-piece.

BRIEF SUMMARY OF THE INVENTION

The present invention is an endless-belt grinder-attachment apparatus for any of the well-known hand-held power tools (e.g., power-drills or disc-grinders), the apparatus being configured so as to enable an operator of such tools to more proficiently grind or sand irregular surfaces, in particular curved surfaces. The apparatus is shaped so as to be affixable to the drive-shaft, axle, chuck, or spindle of the power tool with which it was to be used, thus permitting a drive-pulley contained within the body of the apparatus is driven by the underlying power tool. A key part of the apparatus of the present invention is a compound belt-support that is connected to, and extends from, the body of the apparatus. This belt-support has a primary-arm and a secondary-arm. An idler-pulley is disposed at each of the distal ends of the primary-arm and the secondary-arm, respectively. A grinding belt is fitted to the device in such a manner that, when the device is in operation, the belt runs around the drive-pulley and both of the idler-pulleys.

One of the arms of the belt-support is shaped in such a way that it can nestingly receive the other arm as the angle between the arms is reduced. This reception can be accomplished by one arm being made from three-sided channel stock having a generally U-shaped cross-section, thereby allowing the other arm to fit within the U. It is possible for both of the arms to be straight, both of the arms to be curved, or for one arm to be straight and the other curved. When an arm is curved, it may have a fixed radius of curvature (i.e., it may be arc-shaped) or it may have a varying radius of curvature, either decreasing or increasing as one moves from the arm's proximal end toward to arm's distal end.

If an arm is curved, one or more pulleys—in addition to the one at the distal end—are mounted along the arm's convex side, so as to keep the belt from sliding on the convex side of the arm. Either or both of the two arms can be of fixed or adjustable length. The secondary arm is pivotably connected to the primary arm. One or both of the arms can have means for providing tension to the endless-belt. Tension may be effected with any suitable spring, elastomer (e.g., an element made of suitable rubber), or any equivalent, well-known means for providing tension.

The apparatus of the present invention is particularly well-suited for use with an elastic endless-belt (i.e., stretchable—as opposed to traditional endless-belts, which are merely flexible, such as is described in pending U.S. application Ser. No. 09/519,086, filed by the present inventors on Mar. 6, 2000. In those applications where an elastic belt is used, it may not be necessary to have separate tension-providing hardware on the device.

Located between the primary and secondary arms is a multifaceted support shelf, which adds greater flexibility to the operation of the apparatus of the present invention. When the two arms are collapsed into a single element, the support shelf is not deployed. When the arms are swung apart at their distal ends, the support shelf may or may not be deployed. Thus there are three qualitatively distinct configurations of the compound belt-support. The first, as stated, sees the secondary arm folded adjacent to the primary arm so that in effect a single arm is presented. In this configuration, the distance between the distal ends of the two arms, and consequently the angle between the two arms, are minimized. In a second configuration, the distal ends of the two arms are separated a sufficient allowing a work piece to enter the gap between the distal ends, while pressing against the belt. In this configuration, the work piece pushes the belt into the gap or sector between the two distal ends. In this mode of operation, the angle between the arms is allowed to freely vary depending on the size of the work piece and the distance the work piece is inserted into the gap (or sector) between the arms. The result is that the belt conforms to the general shape of the portion of the work piece inserted thereby effecting the sanding or grinding of curved and complex contours, in contrast with the limitation of the traditional devices that present only a flat or single-radius-of-curvature grinding surface to the work-piece.

In a third configuration, the support shelf, which is pivotably attached to the secondary arm, is unfolded from its folded position along the secondary arm, and its free end inserted into a receiving notch at the distal end of the primary arm, thus forming a triangular shape around which the moving belt conforms. This configuration enables the user to use any of the sides of the triangular shape for grinding. In addition, when one of the sides in this configuration is perpendicular to the longitudinal axis of the primary arm, a user can apply greater force to the work piece than is possible with the devices of the prior art.

By having two arm-elements, the present invention presents the user with more than one grinding surface with which to work. Additionally, with one arm able to move, the grinding surface can adapt to the surface of the work-piece being worked, with particular application to curved and complex shapes. For example, circular cylindrical members such as pipes can be worked upon by positioning the primary and secondary arms apart, yet with the support shelf remaining folded along the secondary arm. Because the belt spans the gap between the arms, and because in this configuration the support shelf does not support the belt, the belt can conform to the shape of a work piece forced against the belt. In this manner, a pipe may have up to one-half of its circumference sanded or ground concurrently by the present invention.

In another embodiment of the apparatus of the present invention, a vise insert may extend from the body, preferably in line with the longitudinal axis of the primary arm. In this manner the sander can be gripped in a vise, leaving the operator's hands free to manipulate the work piece as it is pressed against the belt. Additionally, a stand may depend from the body of the apparatus, a stand adapted to stabilize the device while the device is used in conjunction with a typical power-drill that is laid on its side on a flat surface.

The apparatus of the present invention as described above should immediately lead one skilled in the art to various specific embodiments of the invention. The Preferred Embodiment of the invention is set out in detail below to give some definitiveness to the apparatus. However, there is no intention by so doing to limit the scope of the invention either by the Preferred Embodiment description or by the embodiments referenced in the Summary above.

BRIEF DESCRIPTION OF THE DRAWINGS

FIG. 1B shows a side view of the Preferred Embodiment of the present invention, in which the primary arm and the secondary arm are spread apart, with the support-shelf deployed in between.

DETAILED DESCRIPTION OF THE PREFERRED EMBODIMENT OF THE INVENTION

Figure 1A:
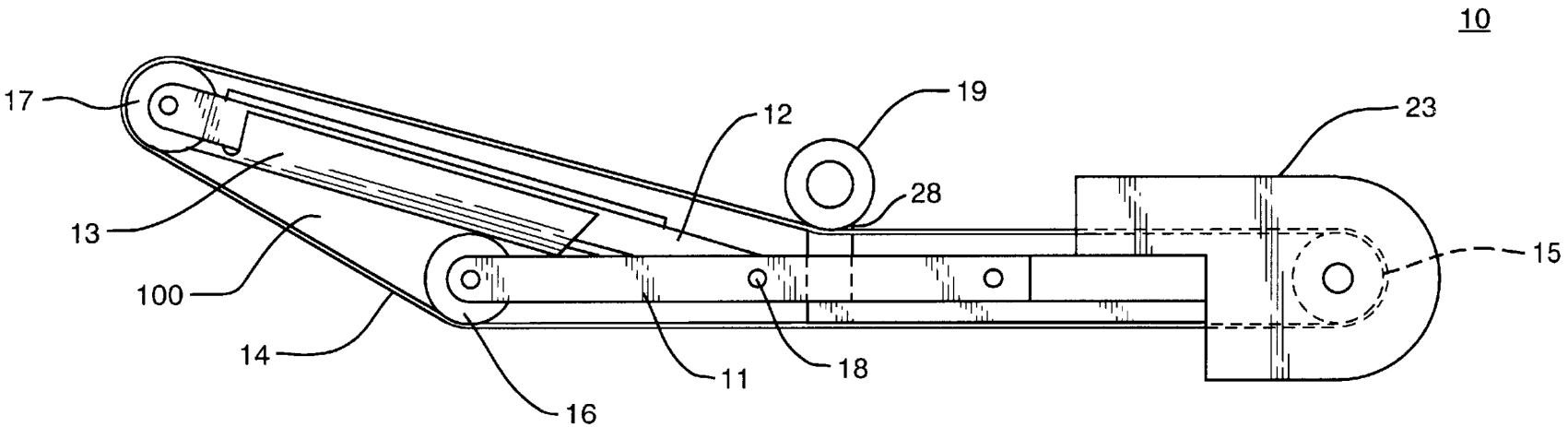
FIG. 1A shows a side view of the Preferred Embodiment of the apparatus of the present invention.
Figure 1B:
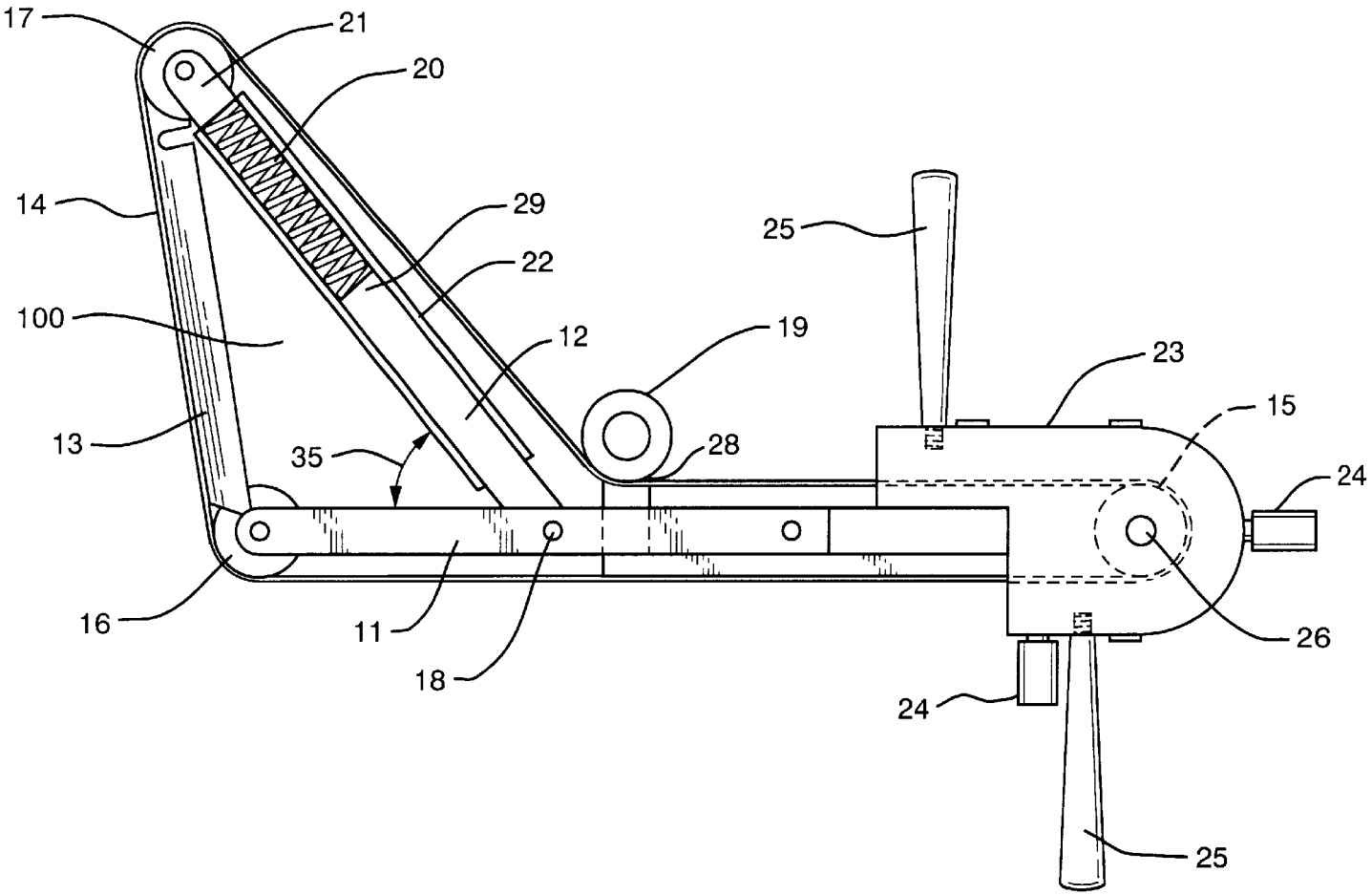
Figure 1C:
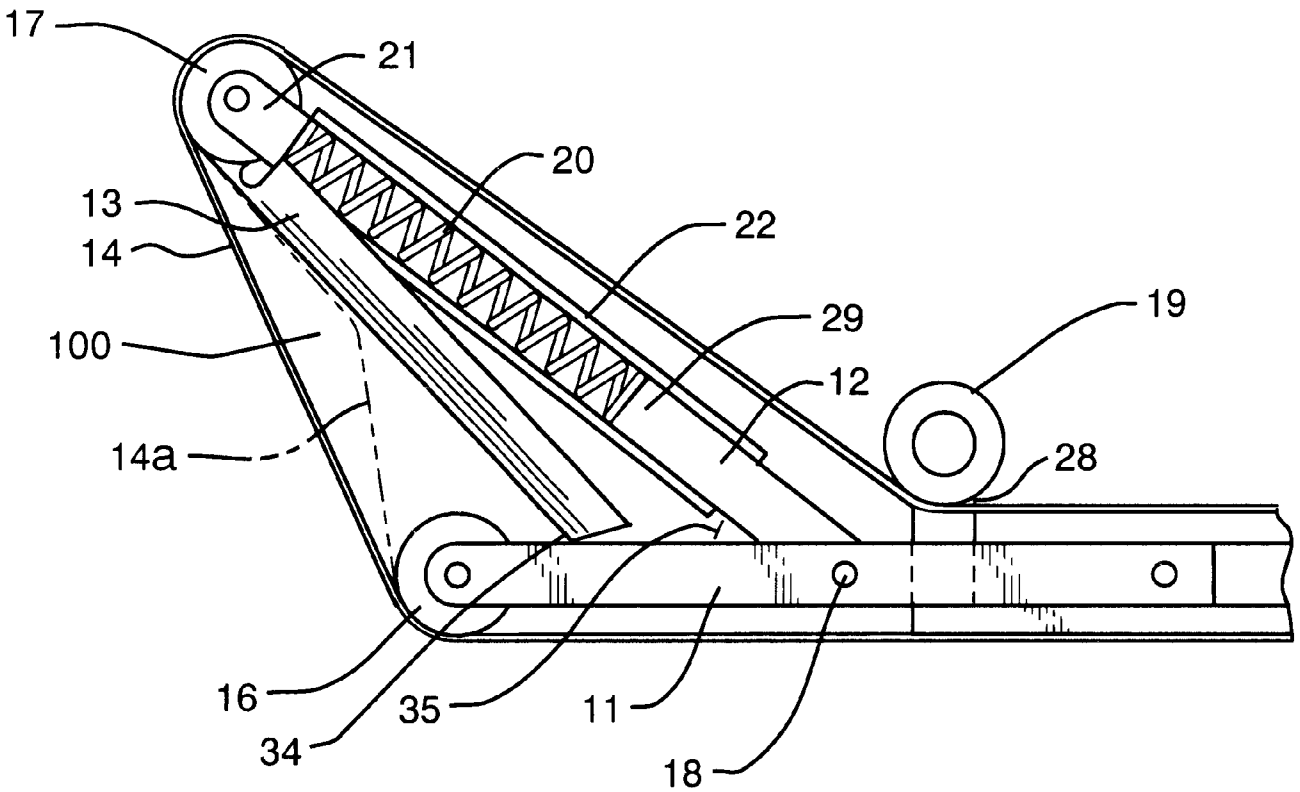
FIG. 1C is a side view of the Preferred Embodiment of the present invention showing the primary arm and secondary arm spread apart without the support-shelf deployed, in a configuration for working on an arcuate work piece.
Figure 2:
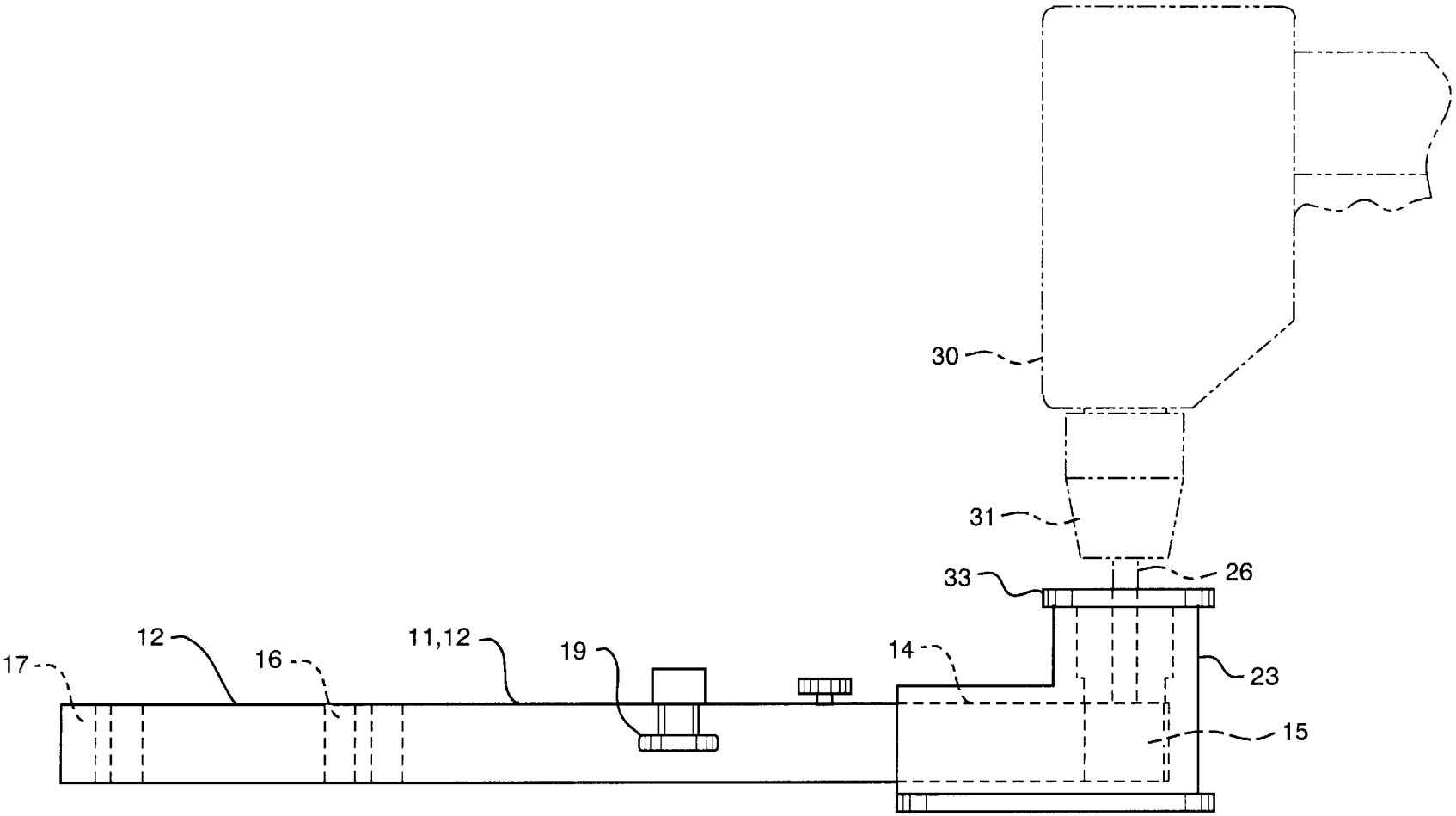
FIG. 2 is a plan view that shows the Preferred Embodiment of the present invention coupled to a representative power drill.

FIG. 1A, FIG. 1B and FIG. 1C show the Preferred Embodiment of the present invention—a contour-sander attachment device 10—by itself, unattached to any power tool. As shown on the right side of FIG. 1A, the device 10 includes a body 23 that houses a drive-pulley 15. It is the drive-pulley 15 that provides the motive force to a sanding belt 14 when the device 10 is in use. As shown in FIG. 2, the motive force causing the drive-pulley 15 to rotate comes from a drive axle 26 that is coupled to a chuck 31 of a power tool 30 when the device 10 is in use. As further shown in FIG. 1B, the drive axle 26 is rotatably mounted in and supported by the body 23 by means of a bearing assembly 32.

When the device 10 is in operation, the sanding belt 14—driven by the drive-pulley 15—runs around a path a portion of which, the working portion, passes over a belt-support 100, as shown in FIG. 1A and elsewhere. The belt-support 100 extends laterally from the body 23. The working portion of the path is that portion that passes over the belt-support 100, since it is in that region that a work-piece 36 will be pressed against the sanding belt 14. The belt-support 100 is the Preferred Embodiment for the key part of the present invention. It is the belt-support 100 (and its equivalent in other embodiments) that offers the broad diversity of backing surfaces that marks the advantage of the present invention over the traditional art.

As shown in particular by FIG. 1A, FIG. 1B and FIG. 1C, the belt-support 100 is a compound entity containing three main parts: a primary-arm 11, a secondary-arm 12, and a support-shelf 13. Its direct connection with the body 23 is through the primary-arm 11, which is fixedly mounted to the body 23. The secondary-arm 12 is pivotably connected to the primary-arm 11 at a pivot pin 18. The support-shelf 13 is in turn pivotably connected to the secondary-arm 12 and has a free end 34. FIG. 1A shows the belt-support deployed in a closed configuration where the support-shelf 13 is completely folded against the secondary-arm 12 and the secondary-arm 12 is close to being folded against the primary-arm. When the secondary-arm 12 is completely folded into the primary-arm 11, the surface that the secondary-arm 12 presents to the sanding belt 14 is parallel to the surface that the primary-arm 11 presents to the sanding belt 14. FIG. 1C shows the secondary-arm 12 further lifted away from the primary-arm 11, with an inter-arm angle 35 being determined by the degree to which the support-shelf 13 is unfolded from the secondary arm 12. The friction contact between the distal end of the support-shelf 13 (its end farthest from the secondary-arm 12) and the inside of the primary arm 11 establishes the magnitude of the inter-arm angle 35.

FIG. 1B shows the belt-support deployed in a closed configuration where the support-shelf 13 is fully opened and locked into place, its free end 34 being fixed to the distal end of the primary-arm 11. In this configuration, the three major components of the belt-support 100 form a rigid triangle over which the sanding belt 14 runs when the device is in use. This allows the operator to use any one of three planar backing surfaces for the sanding of a work-piece 36.

A primary-arm idler-pulley 16 is disposed at the distal end (with respect to the body 23) of the primary-arm 11. Similarly, a secondary-arm idler-pulley 17 is disposed at the distal-end of the secondary-arm 12. The primary-arm idler-pulley 16 and the secondary-arm idler-pulley 17 facilitate the passage of the sanding belt 14 over the working path. Further aiding the sanding belt 14 to remain on path is a retainment-arm pulley 19 disposed at the end of a retainment-pulley arm 28. The retainment-pulley arm 28 is pivotably connected to the primary-arm 11 between the pivot-pin 18 and the body 23.

In order to maintain tension on the sanding belt 14, a spring-loading means is provided in the secondary-arm 12. This is accomplished by dividing the secondary-arm 12 into a movable section 21 and a fixed section 29, both of which are enclosed in a sleeve 22. (Here, "fixed" refers to the position within the sleeve 22; the entire secondary-arm 12 can rotates about the pivot pin 18.) Inside of the sleeve 22 and disposed between the movable section 21 and the fixed section 29 is a spring 20. In this way, the total length of the secondary-arm 12 varies, depending on the configuration of the device 10 and in particular on the configuration of the belt-support 100. The sleeve 22 constrains the spring 20 and the movable section 21 to move in a direction coaxial to the longitudinal axis of the fixed section 29. As the sanding belt 14 travels around the drive-pulley 15, the primary-arm idler-pulley 16, the secondary-arm idler-pulley 17, and the retainment-arm pulley 19, the spring 20 extends the movable section 21 against the resistance of the sanding belt 14, thus maintaining tension in the sanding belt 14.

To efficiently sand or grind a curved contour of a work-piece using the preferred embodiment device of the present invention, the belt-support is deployed in a partially open configuration with the support-shelf 13 partially unfolded, as shown in FIG. 1C. This permits the secondary-arm 12 to move angularly in relation to the primary-arm 11, thereby allowing the inter-arm angle 35 to vary. To give the inter-arm angle 35 definition, the free end 34 of the support-shelf 13 can be frictionally held in place at any predetermined location along the primary-arm 11. When a work-piece 36 is pushed against the belt 14, the belt moves to deflected position 14*a* into the inter-arm sector defined by the primary-arm 11 and the secondary-arm 12. The belt 14, being under the tension induced by spring 20 and the retainment-arm pulley 19, conforms to the general shape of the work-piece 36.

As shown in FIG. 1B, the present invention can also be configured so that the free end 34 of the support-shelf 13 is received by the distal end of the primary-arm 11. In this configuration, the primary-arm 11, the secondary-arm 12, and the support-shelf 13 together form a triangular shape. In such a configuration the support-shelf 13 is substantially perpendicular to the primary-arm 11. This provides a flat, relatively stable face with which to sand the work-piece 36, and allows the user to exert a greater force on the power tool (and consequently on the work-piece) than would be possible without the support-shelf 13. Any one of the three sides of the triangular shape, around which the belt 14 rotates, can be used to sand or grind the work-piece 36.

FIG. 2 shows a plan view of the device 10 coupled to a representative power-drill 30. As coupled, a chuck 31 of the power-drill 30 is closed about a drive-axle 26 of the contour-sander attachment 10.

Figure 3:
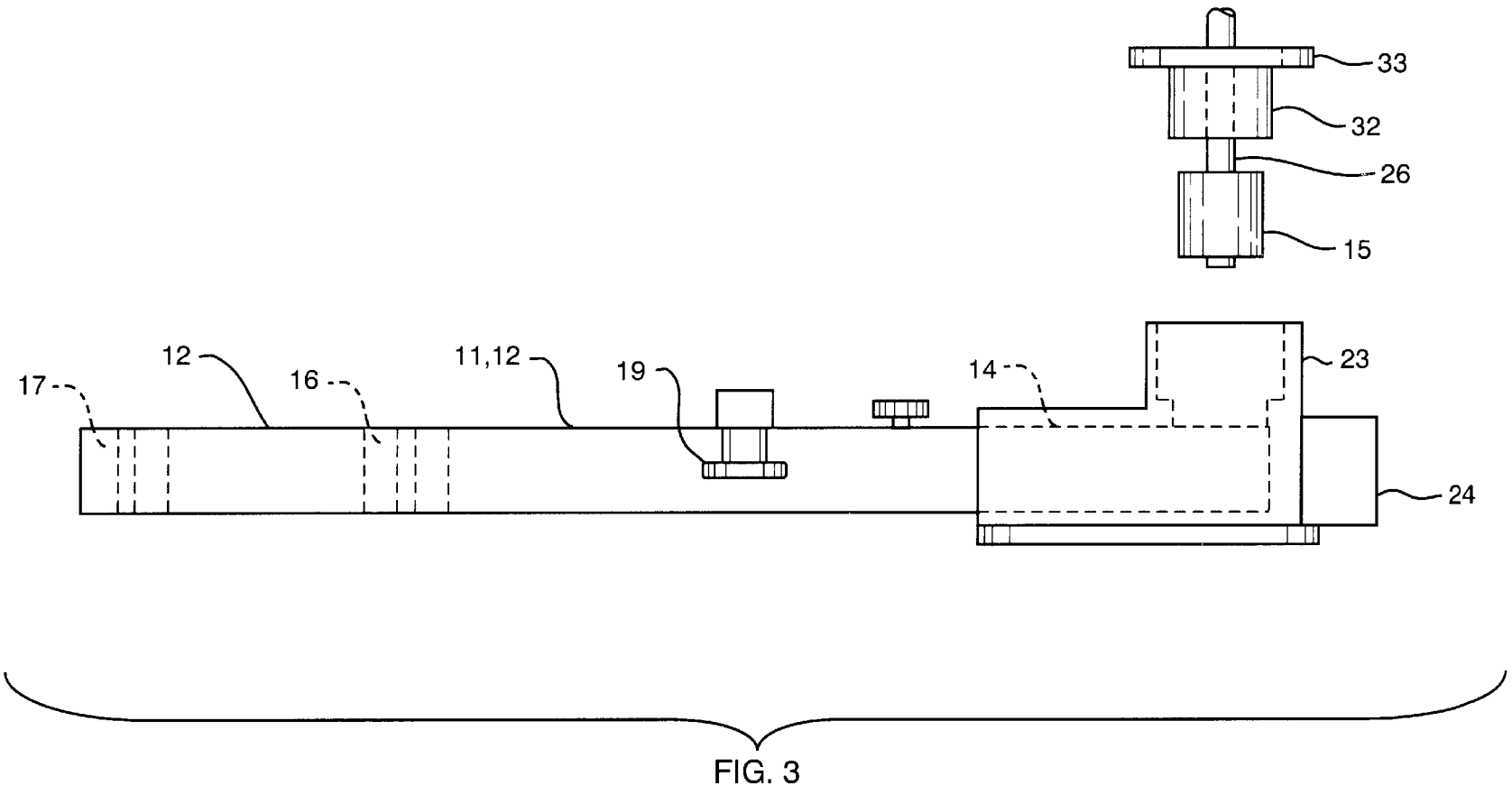
FIG. 3 depict, through a partially exploded view of the Preferred Embodiment of the present invention, some interior details of the body of the completed device.

FIG. 3 shows a partially-exploded view of the device 10, in which the bearing 32 supporting the drive-axle 26 is floating above the body 23. a receiving-cup 33 adapted to enclose the exposed chuck 31 of the power-drill 30 is also depicted This receiving cup 33 protects the operator of the contour-sander attachment 10 from inadvertent contact with the chuck 31. (In the variant that allows the chuck 31 to be safely enclosed within receiving cup 33 the drive-axle 26 is shorter than it is shown to be in FIG. 2.)

Any of a variety of existing abrasive belt products can be used with the device 10, the Preferred Embodiment device of the present invention. However, in the Preferred Embodiment method of the present invention, the sanding belt 14 is an elastic abrasive belt as described in pending U.S. application Ser. No. 09/519,086, filed by the present inventors on Mar. 6, 200. Further, in the Preferred Embodiment method, the sanding belt 14 has a width of 1 inch, and a circumferential length of 30 inches.

The Preferred Embodiment device and method of the present invention have been set out with some particularity for the purpose of clearly illustrating the invention and instructing the reader in the best means of practicing their invention currently known to the inventors. However, the invention itself, as it relates to both the device and the method, is much broader than contained in the detailed description, and no limiting of that invention was intended by the Preferred Embodiment discussion.

What is claimed is:

1. A contour-sander attachment for enabling a variety of work-piece shapes to be efficiently sanded said device comprising a power take-off coupling means by which said device can be removably affixed to a power tool, a belt-support, and a means of causing a continuous sanding belt to follow a working path along said belt-support;

wherein said belt-support comprises a primary arm, a secondary arm, and a support shelf; and wherein said primary arm is pivotally connected to a secondary arm, and said support shelf is pivotally attached to said secondary arm and movable from a folded position to an open position in which said support shelf is secured between said secondary arm and said primary arm.

2. The device described in claim 1 also comprising a tensioning means to maintain tension in said sanding belt while said sanding belt is running over said belt-support.

3. The device described in claim 2 wherein said tensioning means is a spring embedded in said secondary arm, said spring being loaded so as to tend to extend said distal end of said secondary arm against said sanding belt.

4. The device described in claim 3 also comprising a primary-arm idler pulley deployed at said distal end of said primary arm and a secondary-arm idler pulley deployed at said distal end of said secondary pulley, wherein said primary-arm idler pulley and said secondary-arm idler pulley together define a path for said sanding belt to travel.

5. The device described in claim 4 also comprising a retainment-arm pulley past which said sanding belt is constrained to run, wherein said retainment-arm pulley helps guide said sanding belt when said secondary arm is opened pivoted away from said primary arm.

6. The device described in claim 5 where said secondary arm is comprised of a fixed section and a moving section, wherein said moving section includes said distal end of said secondary arm and wherein said moving section is connected to said fixed section by said spring.

7. The device described in claim 6 wherein said power take-off coupling means comprises a drive-axle, a bearing mount, and a drive-pulley, wherein said drive-axle is shaped so as to fit within a chuck element of a typical hand drill, said drive-pulley is fixedly attached to said drive-axle so that said drive-pulley is caused to be rotated co-axially with said drive-axle, and said drive-axle rotates within and is supported by said bearing mount.

8. A method of finish-sanding an irregular surface of a work piece using apparatus described in claim 1 said method comprising the steps of (1) attaching said apparatus to a hand held drill;

(2) mounting a sanding belt on said apparatus;

(3) partially opening said compound belt-support so that said compound belt-support presents two flat backing surfaces and one flexible surface, said flexible surface being in an inter-arm region;

(4) activating said hand-held drill so as to start said sanding belt moving around across said compound belt-support;

(5) pressing each flat surface of the work piece in turn against said sanding belt in a region where said sanding belt is passing one of said two flat backing surfaces;

(6) pressing each curved surface of said work piece in turn against said sanding belt where said sanding belt is passing across said inter-arm region, using enough force so as to cause a maximum fraction of said curved surface to be exposed to said sanding belt.

9. The method described in claim 8 wherein said sanding belt is an elastic abrasive belt.

10. A contour-sander attachment apparatus for use in conjunction with power tools, said apparatus comprising a body having a drive-pulley disposed therein, said drive-pulley having a drive-axle extending therefrom;

a primary-arm fixedly connected to said body, with a primary idler-pulley rollingly attached to a distal end of said primary-arm a secondary-arm pivotably attached to said primary-arm at an attachment-point, with a secondary idler-pulley disposed at a distal-end of said secondary-arm, a support-shelf having a pivoting end and a free end, said support-shelf being pivotably connected at said pivoting end to said distal end of said distal end of said secondary arm, said free end being adapted to engage said distal-end of said primary-arm when said support-shelf is a fixed open position, and said free end being adapted to fit into said proximal portion of said secondary arm when said support shelf is in a closed position.

11. The apparatus of claim 10 wherein said secondary-arm further comprises a slidable section containing said distal end of said secondary arm, a non-slidable section, a spring running between said slidable section and said non-slidable section, and a sleeve surrounding said non-slidable section, said spring, and a portion of said slidable section, all disposed so that said slidable section can slide along said sleeve under action of said spring, thereby applying tension to a belt running over said distal end of said secondary arm.

12. The apparatus of claim 11 further comprising a retainment-arm within which is mounted a retainment pulley, said retainment-arm being pivotably connected to said primary-arm between said body and said attachment point, said retainment pulley being so disposed as to allow said belt to run over it.

* * * * *